United States Patent [19]

Bychinsky

[11] 3,966,015

[45] June 29, 1976

[54] SILENCER ELEMENT

[75] Inventor: Wilfred A. Bychinsky, Burton, Mich.

[73] Assignee: General Motors Corporation, Detroit, Mich.

[22] Filed: Feb. 19, 1975

[21] Appl. No.: 551,017

[52] U.S. Cl. ..... 181/56; 181/33 L; 181/69

[51] Int. Cl.[2] ..... F01N 1/08

[58] Field of Search ..... 181/36 B, 33 L, 33 H, 181/41, 44–46, 49, 56, 61, 69

[56] References Cited

UNITED STATES PATENTS

| | | | |
|---|---|---|---|
| 1,577,626 | 3/1926 | Warth | 181/69 |
| 2,132,425 | 10/1938 | List | 181/44 |
| 2,162,683 | 6/1939 | Tobin | 181/69 |
| 2,392,247 | 1/1946 | Katcher | 181/69 |
| 3,700,069 | 10/1972 | Rausch | 181/44 |
| 3,812,008 | 6/1974 | Evans et al. | 181/33 H |
| 3,812,931 | 5/1974 | Hauskins | 181/33 L |
| 3,842,940 | 10/1974 | Bonikowski | 181/33 L |

*Primary Examiner*—L. T. Hix
*Assistant Examiner*—Vit W. Miska
*Attorney, Agent, or Firm*—J. C. Evans

[57] ABSTRACT

A wave interference silencer includes a sealed envelope having an inlet and an outlet in communicaton with an exhaust flow volume therebetween which is divided into a plurality of compartments by spaced apart intermediate wall portions each having an exhaust opening therein to define a continuous exhaust flow path from the inlet to the outlet ends of said envelope and wherein each compartment further includes a flow diverting baffle to prevent linear flow of exhaust through said exhaust flow openings and to define a first and second curvilinear flow path around each baffle each having an acoustical flow path length to produce wave interference silencing of a predetermined noise frequency within each compartment without obstructing exhaust flow between the inlet and outlet of the envelope.

3 Claims, 6 Drawing Figures

SILENCER ELEMENT

This invention is directed to sound muffler assemblies and more particularly to sound muffler assemblies for attenuating noise in engine exhaust by wave interference silencing of predetermined frequencies of sound in the exhaust passing between the inlet and outlet of a muffler construction.

Various muffler construction configurations have been proposed that utilize the theory of wave interference silencing to attenuate noise frequencies in the exhaust flow from an engine. One example of such a configuration is set forth in U.S. Pat. No. 2,132,425 where a plurality of curvilinear paths are defined between the inlet and outlet of a muffler with the paths having various acoustical lengths which will produce a degree of wave interference silencing of certain sound frequencies in the exhaust passing from the inlet to the outlet. In other arrangements a helical baffle is located between the inlet and outlet of a wave interference silencer tube to produce a variable length acoustical path between axially spaced points in the muffler construction to also afford attenuation of sound frequencies in the exhaust flow through the tube. An example of this type of the silencer is set forth in U.S. Pat. No. 3,700,069.

While the aforesaid muffler constructions are suitable for their intended purpose it is recognized that fabrication of such assemblies involves the necessity of forming baffle elements to define curvilinear paths of different lengths. For example, in U.S. Pat. No. 2,132,425 the muffler has a general spherical configuration with a need for forming curvilinear baffle plates to produce the differing length acoustical paths necessary to produce effective wave interference attenuation of the exhaust flow through the muffler. Likewise, in U.S. Pat. No. 3,700,069 it is necessary to fabricate a helical baffle and then attach it to an inner tube defining a shorter length acoustical path and further to locate the helical baffle with respect to an outer case to define a greater length outer acoustical path to produce wave interference attenuation of acoustical energy in the exhaust flow through the device.

An object of the present invention is to improve wave interference silencers by the provision of a single outer envelope having an inlet and an outlet and an exhaust flow volume therebetween which is completely swept by exhaust flow therethrough and which has no pockets for condensation of vapors or collection of condensate present in the exhaust flow gases and wherein the exhaust flow volume is separated into a plurality of separate compartments by means of a plurality of spaced apart intermediate wall portions each having flow openings therein arranged along a linear path between the inlet and the outlet and wherein a flat plate baffle is located within each of the compartments and arranged with respect to the opening to define a pair of acoustical paths of differing length to produce attenuation of acoustical energy within each of the compartments without restricting or impeding the flow of exhaust gas through the envelope.

Yet another object of the present invention is to provide an improved wave interference silencer construction having a generally triangularly configured envelope having an inlet and an outlet from an exhaust flow volume which is separated into a plurality of separate noise attenuation compartments each formed by a flat plate intermediate wall portion with an opening therein and wherein a separate flat plate baffle is located within each of the compartments to define a pair of curvilinear flow paths of differing acoustical lengths to produce wave interference attenuation of acoustical energy in each of the compartments and wherein each of the compartments is of a reduced width from the inlet to the outlet of the envelope and each of the baffles defines a pair of acoustical curvilinear paths of a reduced length from compartment to compartment to produce an attenuation of a wide range of frequencies in exhaust flow from the inlet to the outlet of the exhaust flow volume.

Yet another object of the present invention is to provide an improved wave interference silencer with a rectangularly configured envelope having an inlet and an outlet from an exhaust flow volume separated into a plurality of separate compartments by intermediate walls and wherein each of the intermediate walls includes an exhaust flow opening arranged along a common axis between the inlet and the outlet wherein the axis is inclined with respect to the longitudinal axis of the rectangularly configured envelope and with each of the compartments further including a flat plate baffle located therein having opposite ends thereof spaced with respect to the envelope to define a pair of curvilinear acoustical paths through each of the compartments for directing exhaust flow to completely sweep each of the compartments and to further produce a wave interference cancellation of a predetermined level of acoustical energy in the exhaust flow through each of the compartments, the opening in the intermediate compartment walls being offset with respect to one another and the flat plate baffles having a common length to produce attenuation of a wide range of frequencies in the exhaust flow from the inlet to the outlet of the envelope.

Further objects and advantages of the present invention will be apparent from the following description, reference being had to the accompanying drawings wherein a preferred embodiment of the present invention is clearly shown.

Figure 1:
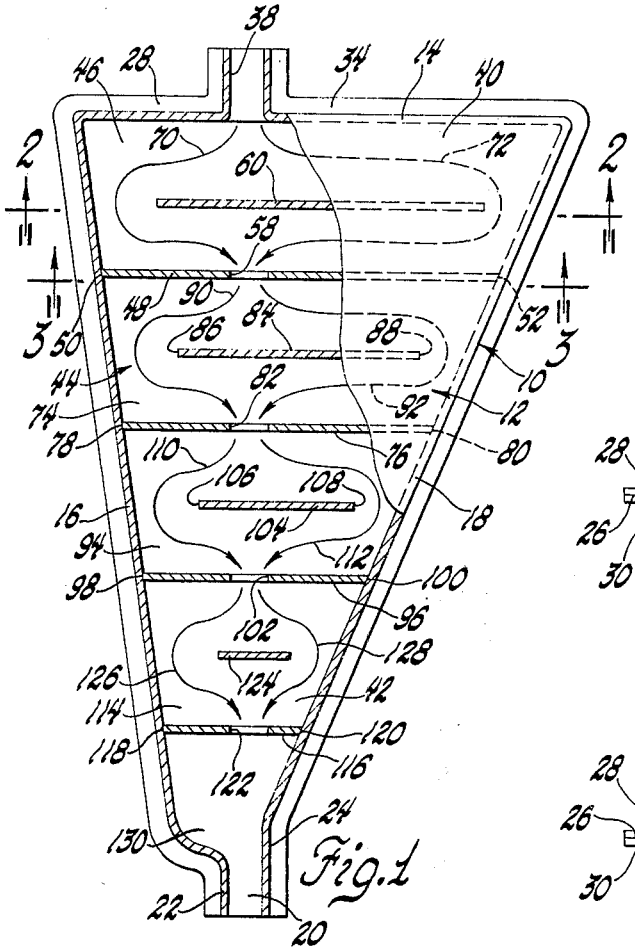
FIG. 1 is a top elevational view of a first embodiment of the invention with a cover portion thereof broken away to show intermediate compartment wall and baffle components of the assembly.
Figure 2:
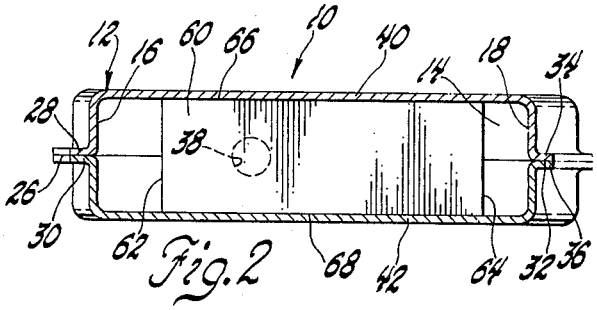
FIG. 2 is a vertical sectional view taken along the line 2—2 of FIG. 1 looking in the direction of the arrows.
Figure 3:
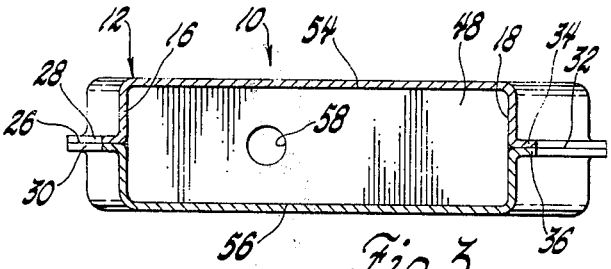
FIG. 3 is a vertical sectional view taken along the line 3—3 of FIG. 1.

Referring now to the drawing, in FIG. 1, a muffler assembly 10 is illustrated including a triangularly configured outer envelope 12 including an inlet end wall 14 having opposite ends thereof joined to spaced apart side walls 16, 18 which converge with respect to one another from the end wall 14 to an outlet opening 20 from the envelope 12 as formed by extensions 22, 24 on the side walls 16, 18, respectively.

In the illustrated embodiment the side wall 16 is configured to have a parting line 26 formed by a pair of flanges 28, 30 directed outwardly along the complete length of the side wall 16. Likewise, the side wall 18 has a parting line 32 formed by flanges 34, 36 also directed outwardly along the complete length of the side wall 18. The parting lines 30, 32 continue along the inlet end wall 14 to merge with an inlet tube 38 on the wall 14 which is located colinearly of the outlet 20 from the envelope 12. The side walls 16, 18 are joined with an envelope cover 40 having a generally triangular planar extent and are further joined to a bottom 42 having a like planar extent. The side walls 16, 18 cover 40 and bottom 42 define an exhaust flow volume 44 that is of continually decreasing cross sectional flow area from the inlet 38 to the outlet 20 so as to produce a general convergence of exhaust flow from the inlet 38 to the outlet 20 which is especially suited to concentrate exhaust flow to assure complete sweep of the volume 44 in a manner to be discussed.

In accordance with certain principles of the present invention the volume 44 is separated into a plurality of acoustical energy attenuation compartments and exhaust flow paths. More particularly, the inlet 38 is in communication with a first compartment 46 that is formed in part by an intermediate wall 48 of flat rectangular configuration. Wall 48 includes ends 50, 52 thereon in sealed relationship to the side walls 16, 18, respectively. The wall 48 further includes an upper edge 54 and a lower edge 56 in sealed relationship to the cover 40 and bottom 42, respectively. The intermediate wall 48 has an exhaust flow opening 58 therein which has a centerline located on an axis defined by the inlet 38 and outlet 20. The compartment 46 further includes a flow dividing baffle 60 located therein of flat rectangular configuration. It includes ends 62, 64 located in spaced relationship to the side walls 16, 18, respectively, and asymmetrically with respect to opening 58. Baffle 60 further includes upper and lower edges 66, 68 joined to the cover 40 and bottom 42 so as to define a flow diverter between the inlet 38 and the exhaust flow opening 58 so that exhaust flow into the compartment 46 is forced along a pair of curvilinear paths 70, 72 to completely sweep the volume of the compartment 46 from the inlet 38 to the exhaust opening 58.

The acoustical length of curvilinear flow path 70 has a predetermined relationship to the acoustical length of the curvilinear flow path 72 and in the illustrated embodiment is of a length one-third of that of the length of the acoustical path represented by the reference numeral 72. The resultant effect of exhaust flow through the compartment 46 is to completely sweep the volume to prevent condensation of vapors or water therein and to produce wave interference cancellation of a first predetermined frequency of noise in the exhaust flow through the volume 44. The exhaust opening 58 defines the inlet to a second exhaust flow compartment 74 within the volume 44 immediately downstream of the compartment 46 and separated from the remainder of the volume by a second intermediate wall 76 that has a flat planar configuration like the intermediate wall 48. Wall 76 includes opposite ends 78, 80 joined to the side walls 16, 18, respectively, and top and bottom edges like edges 54, 56 on wall 48 to close the downstream end of the compartment 74. It includes an exhaust flow opening 82 therein also located on the axis through the inlet 38 and outlet 20 and the compartment 74 further includes a second flow diverting baffle member 84 of flat plate configuration and arranged in spaced parallelism to the wall portions 48, 76 to provide a flow divider between the entrance flow to the compartment 74 and exhaust flow therefrom through the opening 82. The baffle 84 includes opposite ends 86, 88 thereon spaced with respect to the side walls 16, 18 and asymmetrical to opening 82 to define an exhaust path through the volume 74 including a first curvilinear path represented by the reference numeral 90 in FIG. 1 and a second acoustical path represented by the reference numeral 92. It will be noted that the pair of curved acoustical flow paths 90, 92 completely sweep the volume of the compartment 74 during exhaust flow therethrough. Additionally, it will be noted that the lengths of the curvilinear paths are slightly reduced as compared to the acoustical paths 70, 72. Moreover, the acoustical path 92 has a length which exceeds that of path 90, in the illustrated embodiment by a length two times that of the length 90, thereby to produce wave interference cancellation of acoustical energy of a differing frequency from that within the compartment 46.

Flow from the opening 82 is into a third reduced volume compartment 94 defined by the side walls 16, 18, cover 40, bottom 42 and an intermediate compartment wall 96 having its ends in sealed engagement with the side walls at 98, 100 and its top and bottom edges sealed with respect to the cover and bottom as in the case of the prior recited intermediate walls 48, 76. The wall 96 includes an exhaust opening 102 therein again arranged in alignment with previously recited wall openings 58, 82 to direct exhaust from the chamber 94. A flow diverting baffle 104 is located within the chamber 94 in overlying relationship in an axial direction to the openings 82, 102. It has opposite ends 106, 108 thereon in spaced relationship to the side walls 16, 18, respectively and asymmetrical. It is located so as to define a pair of curvilinear flow paths between the openings 82, 102 represented by the reference numerals 110, 112. This causes the exhaust to sweep through the chamber 94 as in the previously mentioned chambers. The lengths of the flow paths 110 and 112 are selected to produce wave interference cancellation of a third frequency in the exhaust.

The muffler further includes a fourth exhaust compartment 114 that is communicated by the opening 102 with the upstream compartments of the muffler assembly 10. The compartment 114 is formed by an intermediate wall 116 having ends 118, 120 sealed to the side walls 16, 18, respectively, and upper and lower edges sealed with respect to the cover and the bottom. It includes an exhaust opening 122 therein aligned with the exhaust openings in the previously mentioned intermediate wall portions. A baffle 124 is located within the compartment 114 between the openings 102, 122 to divert exhaust flow through the compartment 114 through an exhaust path 126 and an exhaust path 128 each having an acoustical length relationship to produce wave interference cancellation of still another frequency level in the exhaust flow through the assembly 10.

An outlet compartment 130 is formed downstream of the opening 122. It has a reduced volume so that the exhaust will be maintained at a substantial velocity as it departs through the exhaust opening 20. In the aforesaid arrangement, the component parts of the multiple frequency attenuation silencing components are all comprised of flat plate components easily fabricated and easily assembled to produce wave interference attenuation of a wide range of sound frequencies in the exhaust flow through the assembly 10. The triangular envelope configuration of the assembly 10 lends itself to vehicle applications. Furthermore, the arrangement of the wave interference components in the assembly 10 set forth above produce a configuration wherein all of the exhaust flow volume in the assembly 10 is continuously swept by exhaust flow therethrough to prevent accumulation of condensation within the assembly 10.

Figure 4:
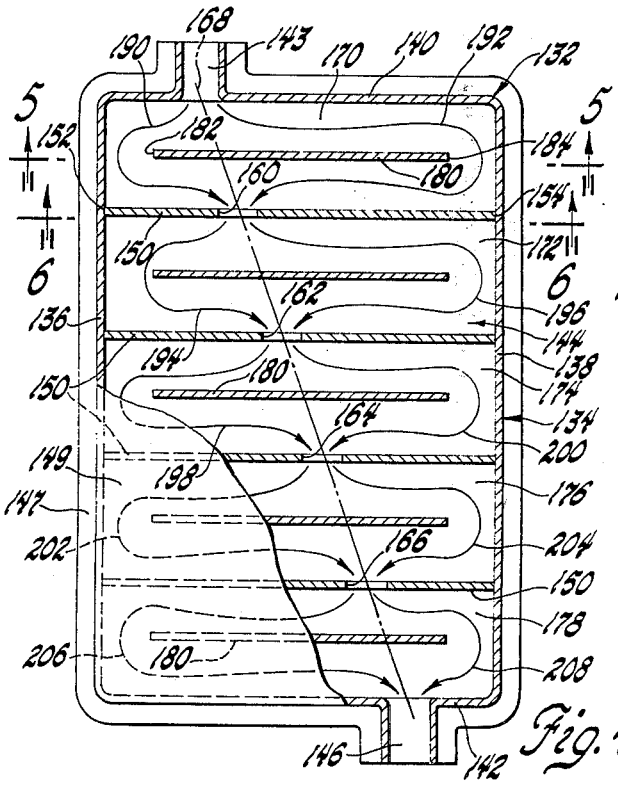
FIG. 4 is a top elevational view of a second embodiment of the present invention with its cover removed.
Figure 5:
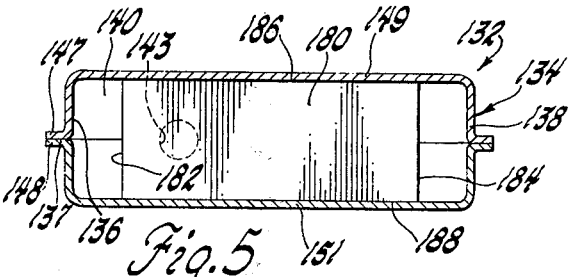
FIG. 5 is a view in vertical section taken along the line 5—5 of FIG. 4.
Figure 6:
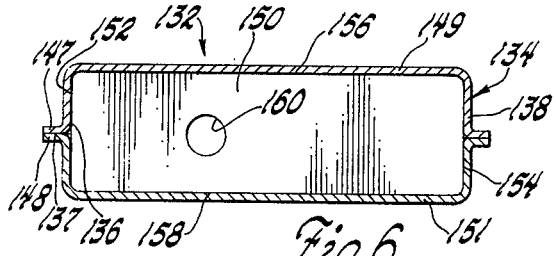
FIG. 6 is a vertical sectional view taken along the line 6—6 of FIG. 4.

Referring now to FIGS. 4 through 6, a second embodiment of the invention is illustrated. It includes a muffler assembly 132 having a generally rectangularly configured outer envelope 134 including spaced apart parallel side walls 136, 138 and parallel end walls 140, 142. The end wall 140 includes an inlet 143 to an exhaust flow volume 144 within the envelope 134 and the end wall 142 has an outlet 146 leading from the volume 144. As in the case of the first embodiment the side wall 136 includes a parting line 137 formed continuously circumferentially therealong and it extends transversely of the envelope 134 along the wall 140 thence along the wall 138 and the wall 142. The parting line is formed by flanges 147, 148 that extend continuously around the envelope.

The envelope includes a cover 149 and a bottom 151 as best seen in FIGS. 5 and 6. As in the case of the first embodiment the exhaust flow volume 144 is separated into a plurality of compartments between the inlet 142 and the outlet 146. More particularly, a plurality of flat plate intermediate walls 150 are located at spaced axial points within the volume 144. Each of the intermediate walls 150 has a like configuration including end portions 152, 154 in sealing engagement with the side walls 136, 138 respectively. Further they include upper and lower edges 156, 158 in sealed relationship with the cover 149 and bottom 151 as best seen in FIG. 6.

A series of exhaust openings are formed in the intermediate walls 150. A first exhaust opening 160 is formed slightly offset from the subsequent exhaust opening 162 in the next intermediate wall 150. Additional exhaust openings are formed in subsequent intermediate walls at 164 and 166 each being offset from the other a like amount so as to form an exhaust flow path from the inlet 143 to the outlet 146 which starts at one diagonal corner of the envelope 134 and ends at the opposite diagonal corner thereof. The openings 160 through 166 are located on a linear path defined by an axis 168 inclined with respect to the longitudinal axis of the envelope 144 as best seen in FIG. 4. The intermediate wall portions 150 thus separate the volume 144 into a plurality of separate compartments 170, 172, 174, 176, 178 all intercommunicated through the exhaust openings 160 through 166. In each of the aforesaid separate compartments a like baffle 180 is located to be in spaced relationship to either the end wall or an intermediate wall of the muffler assembly 132. Each baffle 180 has opposite ends 182, 184 thereon located in spaced relationship to the opposite side walls 136, 138. Moreover, they each include upper and lower edges 186, 188 located in sealed engagement with the cover 149 and bottom 151. respectively. As in the case of the first embodiment the spacing between the side walls and the ends of each of the baffles is equidistant. In this embodiment, however, each of the baffles 180 has an equal length. In this embodiment the exhaust flow through the first compartment 170 takes two curvilinear paths represented by the reference numeral 190 and 192. The reference numeral path 192 is of greater length than the path 190, preferably two times as great, to produce wave interference cancellation of a first predetermined acoustical energy in the exhaust flow through the compartment 170. The curvilinear path of the exhaust flow will completely sweep the exhaust compartment 170 as in the case of the first embodiment. The fact that the second opening 162 is offset transversely of the opening 160 produces a pair of curvilinear flow paths 194, 196 having different acoustical lengths to produce a second wave interference silencing of a second band of acoustical energy as exhaust flows through the compartment 172. Again the volume is completely swept by the exhaust flow therethrough. The offsetting of the openings 164 and 166 produces a like pair of exhaust flow paths 198, 200 in the compartment 174 and a still different pattern of curvilinear flow paths 202, 204 in the compartment 176 and 206, 208 in the compartment 178. The offset location of the exhaust openings 160 through 166 and the location of the baffle plates 180 within each of the separate compartments will provide a varying pattern of differing length acoustical paths in each of the compartments which will attenuate a wide range of acoustical energy in the assembly 132. The embodiment illustrated in FIGS. 4 through 6 tends to repeat an acoustical path length pattern and is effective to produce a substantial range of wave interference silencing somewhat reduced from the completely variable configuration shown in the embodiment of FIG. 1. However, in the embodiment of FIGS. 4 through 6 the baffles 180 are similarly configured to simplify the subassembly fabrication of parts of the muffler assembly 132. As in the case of the first embodiment, exhaust flow through the envelope 134 will completely sweep the volume 144 to prevent pockets of condensation therein. Furthermore, it is easily fabricated from flat plate components.

While the embodiments of the present invention, as herein disclosed, constitute a preferred form, it is to be understood that other forms might be adopted.

What is claimed is:

1. A wave interference silencer comprising: a housing having a pair of sidewalls and a top and a bottom joined together to define an exhaust flow volume, an end wall in said housing including an inlet into said exhaust flow volume, an outlet on the opposite end of said housing from said exhaust flow volume, a plurality of intermediate interior walls formed transversely of said volume having ends thereof in sealed relationship to said side walls to separate said exhaust flow volume into a plurality of interior compartments, each of said transverse wall portions including an opening therethrough for communicating adjacent ones of said compartments, a baffle plate located within each of said compartments, each of said baffle plates being formed in spaced parallellism with said intermediate interior walls and including opposite ends thereon in spaced relationship with said side walls to define a continuous flow path through said compartments, each opposite end of each of said baffle plates being laterally spaced asymmetrically with respect to the opening through said intermediate interior walls to define a first acoustical path around one end of said baffle plate and a second acoustical path of greater length than that of said first acoustical path around the opposite end of said baffle plate, said first and second acoustical paths having lengths which define a ratio to produce wave cancellation of a predetermined frequency as exhaust flow passes from said of one compartments around the baffle therein for flow through a downstream opening in an intermediate wall defining a next adjacent compartment within said exhaust flow volume of said housing.

2. A wave interference silencer comprising: a housing formed by a triangularly configured envelope having an inlet wall and a pair of spaced apart side walls joined to said inlet wall and converging with respect to one another axially downstream of said inlet wall, said envelope including a bottom and a top joined to said side walls, an inlet to said envelope, said envelope including an outlet at the apex of the convergence of said side walls axially aligned with said inlet, a plurality of intermediate walls located at spaced apart points within said exhaust flow volume having end portions thereon in sealed relationship with said side walls and top and bottom edges thereon in sealed relationship with said top and bottom of said envelope to form a plurality of separate exhaust flow compartments within said envelope, each of said intermediate walls having an exhaust flow opening therein, each of said exhaust flow openings being located colinearly of one another and colinearly of said outlet, a baffle plate located within each of said compartments having top and bottom edges thereon in sealed relationship with the top and bottom of said envelope and including ends in spaced relationship to said side walls, each of said baffles being disposed within one of said compartments to block direct flow of exhaust linearly of said coaxially arranged openings, said baffles each having a length and opposite ends spaced laterally and asymmetrically of each of said exhaust flow openings to define a first curvilinear flow path around one end of said baffle for unobstructed exhaust flow from one compartment to an adjacent compartment, said baffle further defining a second curvilinear flow path around the opposite end thereof having a greater acoustical length than that of said first curvilinear flow path to produce wave interference silencing of flow around either end of said baffle, each of said baffle plates having a length reduced from compartment to compartment in the downstream direction of flow to produce a wave interference silencing of a plurality of sound frequency ranges during unobstructed exhaust flow through said envelope from the inlet to the outlet end thereof.

3. A wave interference silencer including a rectangularly configured envelope having side walls in spaced parallellism and opposite end walls thereon joined to said side walls, said rectangularly configured envelope further including top and bottom walls, an inlet connected at one end wall of said envelope, an outlet connected to the opposite end wall of said envelope in offset relationship to said inlet, a plurality of intermediate wall portions within said envelope separating said envelope into a plurality of exhaust flow compartments, each of said intermediate wall portions including opposite ends thereon in sealed relationship to said side walls and including an upper and lower edge joined in sealed relationship to said top and bottom walls of said envelope, respectively, a flow diverting baffle located within each of said compartments including upper and lower edges thereon joined to said top and bottom of said envelope and further including opposite ends thereon spaced with respect to said side walls, said baffles being equal length, each of said intermediate wall portions including an opening therein for communicating an adjacent exhaust flow compartment within said envelope, each of said openings in said intermediate wall portions being located in transversely offset relationship to an upstream opening along an axis drawn through the centerline of the inlet and the centerline of said outlet of said envelope, each opposite end of each of said baffles being spaced laterally and asymmetrically of each downstream opening for defining a first curvilinear flow path for exhaust flow around one end thereof and further including a second curvilinear exhaust flow path around the opposite end thereof having an acoustical length proportioned to that of said first curvilinear flow path to produce wave interference silencing of exhaust flow from one of said compartments to the opposite compartment, said offset holes being aligned with respect to said equal length flow diverting baffles to produce a staggered array of first and second length exhaust flow paths from the inlet to the outlet to produce wave interferencing silencing of a plurality of sound frequencies during sound flow of exhaust through said envelope from the inlet to the outlet end thereof.

* * * * *